US006663073B1

(12) United States Patent
Church

(10) Patent No.: US 6,663,073 B1
(45) Date of Patent: Dec. 16, 2003

(54) COLLAPSIBLE ROTATING DISPLAY EASEL FOR HOLDING TWO VISUAL DISPLAYS

(76) Inventor: Alison B. Church, 793 Laclair Rd., Shaftsbury, VT (US) 05262

( * ) Notice: Subject to any disclaimer, the term of this patent is extended or adjusted under 35 U.S.C. 154(b) by 0 days.

(21) Appl. No.: 10/253,693

(22) Filed: Sep. 25, 2002

(51) Int. Cl.[7] ..... A47B 97/04
(52) U.S. Cl. ..... 248/458; 248/465
(58) Field of Search ..... 248/458, 460, 248/463, 464, 465, 349.1

(56) References Cited

U.S. PATENT DOCUMENTS

| | | | | |
|---|---|---|---|---|
| 302,609 | A | | 7/1884 | Wells |
| 598,818 | A | | 2/1898 | Schwab |
| 856,679 | A | | 6/1907 | Buckland |
| 1,559,716 | A | | 11/1925 | Lingle et al. |
| 3,201,080 | A | | 8/1965 | Rose |
| 3,637,185 | A | | 1/1972 | Mikos et al. |
| 3,958,786 | A | * | 5/1976 | Mann ..... 248/176.3 |
| 4,109,892 | A | | 8/1978 | Hartung |
| 4,378,100 | A | | 3/1983 | Minozzi et al. |
| 5,163,651 | A | | 11/1992 | Matsumoto |
| 6,017,012 | A | * | 1/2000 | Henson, Jr. ..... 248/460 |
| 6,213,439 | B1 | * | 4/2001 | Giulie et al. ..... 248/459 |
| 6,427,856 | B1 | * | 8/2002 | Allen ..... 211/163 |

* cited by examiner

*Primary Examiner*—Ramon O. Ramirez
(74) *Attorney, Agent, or Firm*—Jacobson Holman PLLC

(57) ABSTRACT

A collapsible easel which provides a display surface for two visual displays which facilitates a quick and easy alternation between the two visual displays. The easel includes a fixed base and a rotatable base, rotatable with respect to the fixed base. On top of the rotatable base is a visual display support. On opposed sides of the rotatable base are located tray edge braces which support a bottom of an outwardly leaning edge of the visual display. The visual display may be of different heights and/or widths and be of a different median such as flip charts, dry erase boards, foam display boards, etcetera.

11 Claims, 9 Drawing Sheets

COLLAPSIBLE ROTATING DISPLAY EASEL FOR HOLDING TWO VISUAL DISPLAYS

FIELD OF THE INVENTION

The present relates to the use of a collapsible easel which is easily set up to provide for two visual displays and provides for the rotation of the easel to quickly alternate between the two visual displays.

BACKGROUND OF THE INVENTION

During conferences or discussion groups where visual displays are required, it is often times required to make prior arrangements for installation of a display easel to assist in the conference presentation, lecture or discussion group. Sometimes, an easel is not readably available which places the discussion leader at a great disadvantage.

Further, even when an easel is available, the amount of material which may be displayed by the easel is limited by its single display surface. During changing of a visual display, a break in concentration of the audience may result.

Accordingly, there is a need for a portable, collapsible display easel having the capability of supporting two visual displays which may be easily and quickly accessed without hindering the flow of a presentation.

SUMMARY OF THE INVENTION

It is therefore an object of the present invention to provide a collapsible easel which provides a display surface for two visual displays which facilitates a quick and easy alternation between the two visual displays. This object may be achieved by providing a fixed base and a rotatable base, rotatable with respect to the fixed base. On top of the rotatable base is a visual display support. On opposed sides of the rotatable base are located tray edge braces which support a bottom of an outwardly leaning edge of at least one visual display. The visual display may be of different heights and/or widths and be of a different median such as flip charts, dry erase boards, foam display boards, etcetera.

When reference to one visual display is completed, the rotatable base portion is rotated with respect to the fixed base portion so as to present the second visual display previously mounted on the opposite side of the rotatable easel. No interruption in the lecture or discussion is made and the attention of the audience remains fixed on the visual displays. A series of aligned opposing pole magnets cooperate to hold the base portions in proper alignment.

Ease of transport is facilitated by the folding of the visual display support upon itself by folding of two halves of a visual display support to lie parallel to the base portions, having pivoted about a hinge located at the lowermost edge of the visual display support. A locking mechanism ensures the extension of the visual display support, to its full height. A second hinge provides a slight inclination of the visual display support with respect to the rotatable base portion. The second hinge is foldable to allow for the lay flat condition of the visual display support.

Along a top edge of the visual display support, on at least one side of the visual display support, are a series of hooks for interengaging with holes, binding wires or other cooperating structure to secure a top edge of the visual display to the visual display support.

In an alternate embodiment, extending from the fixed base portion of the two part base portion is a vertical support stand interconnected with the fixed base portion at one end and having four collapsible feet at an opposite end. The feet are pivotally mounted to the vertical support stand so as to reduce the overall bulkiness and handlability of the collapsible easel during transport. The legs are quickly returned to a position of use and secured in position by clamps to provide a stable fixed support for the overall assembly.

Accordingly, it is an object of the present invention to provide a collapsible easel with a fixed base portion and a rotatable base portion having a visual display support extending from and being collapsible onto the rotatable base portion.

It is another object of the present invention to provide a collapsible easel with a fixed base portion and a rotatable base portion having a visual display support extending from and being collapsible onto the rotatable base portion with the vertical display support being foldable in two so as to lie parallel to the rotatable base portion.

It is still yet another object of the present invention to provide a collapsible easel with a fixed base portion and a rotatable base portion having a visual display support extending from and being collapsible onto the rotatable base portion with the vertical display support being foldable in two so as to lie parallel to the rotatable base portion and a vertical support stand mounted on the fixed base portion with the vertical support stand having collapsible legs to facilitate transport of the assembly.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
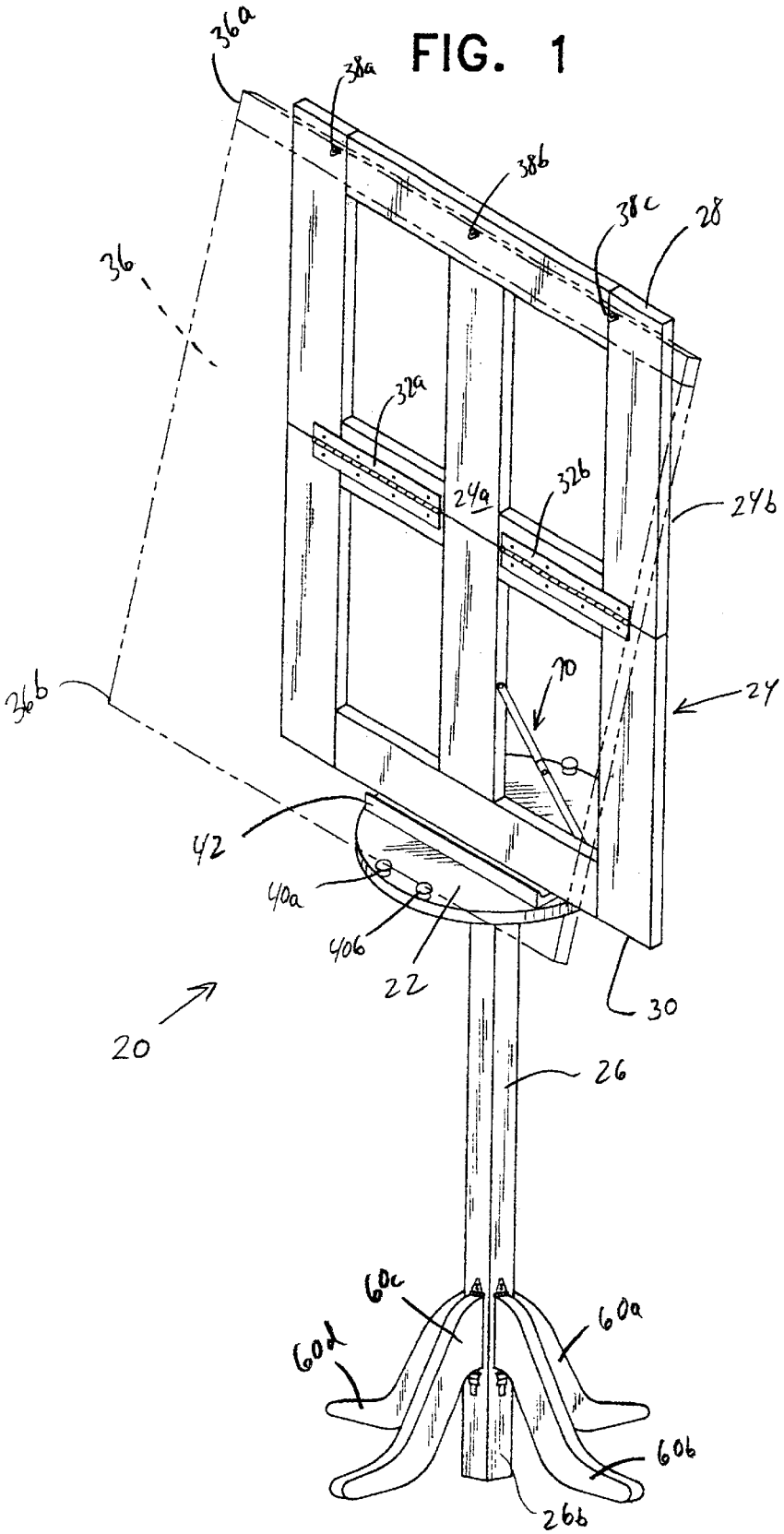
FIG. 1 is a perspective view of the collapsible revolving easel of the present invention showing a visual display device mounted on one side of a visual display support.
Figure 2:
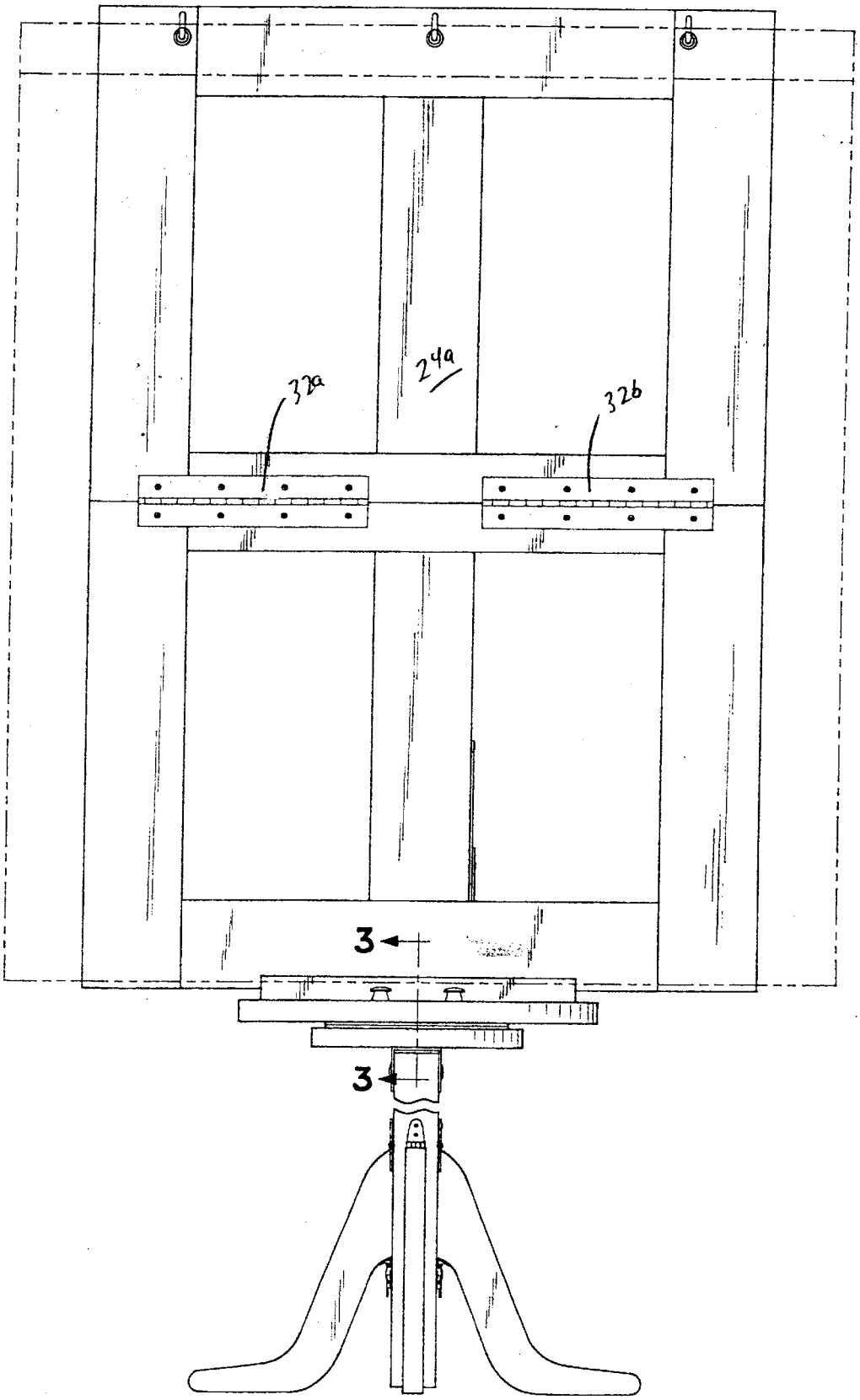
FIG. 2 is an enlarged view of a visual display device connected to a series of projected hooks mounted at a top edge of the visual display support.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 8, in particular, a collapsible revolving easel embodying the teachings of the subject invention is generally designated as 20. With reference to its orientation in FIG. 1, the collapsible revolving easel assembly includes a base portion 22, a vertically extending visual display support 24 and a vertical support stand 26.

Figure 4:
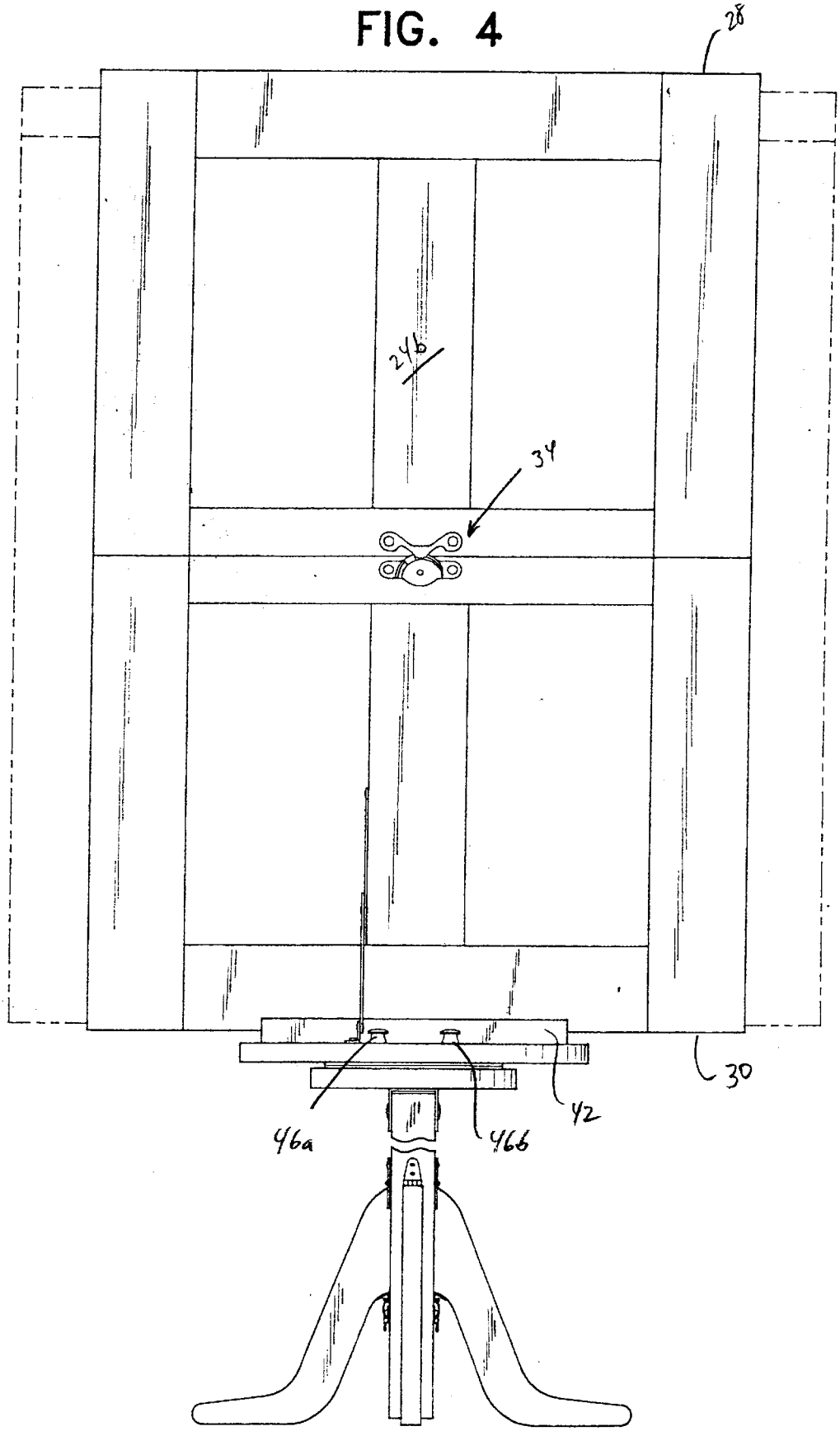
FIG. 4 is a rear view of the present invention illustrating the interconnection of two halves of the visual display support and the hinge interconnecting the visual display support and the rotatable base portion.

The visual display support includes a front surface 24*a* and a rear surface 24*b*. Further, the visual display support is divided into two sections, an upper section 28 and a lower section 30. The two sections 28, 30 are interconnected on surface 24*a* by two hinges 32*a*, 32*b*. On the opposite surface 24*b*, as shown in FIG. 4, the two sections 28, 30 are interconnected by a locking assembly 34.

The visual display support extends from the base 22 so as to support a visual display 36 as shown in dotted lines in FIGS. 1, 2, 4 and 5. At the top edge of the visual display support, in upper section 28 of the support, are located a plurality of hooks 38*a*, 38*b*, 38*c* which may cooperate with the visual display 36 for anchoring the upper edge 36*a* of the visual display 36. Alternatively, the visual display may extend from the base 22 and lean against an upper portion of upper section 28, with lower edge 36*b* sitting on top of the base 22.

Figure 5:
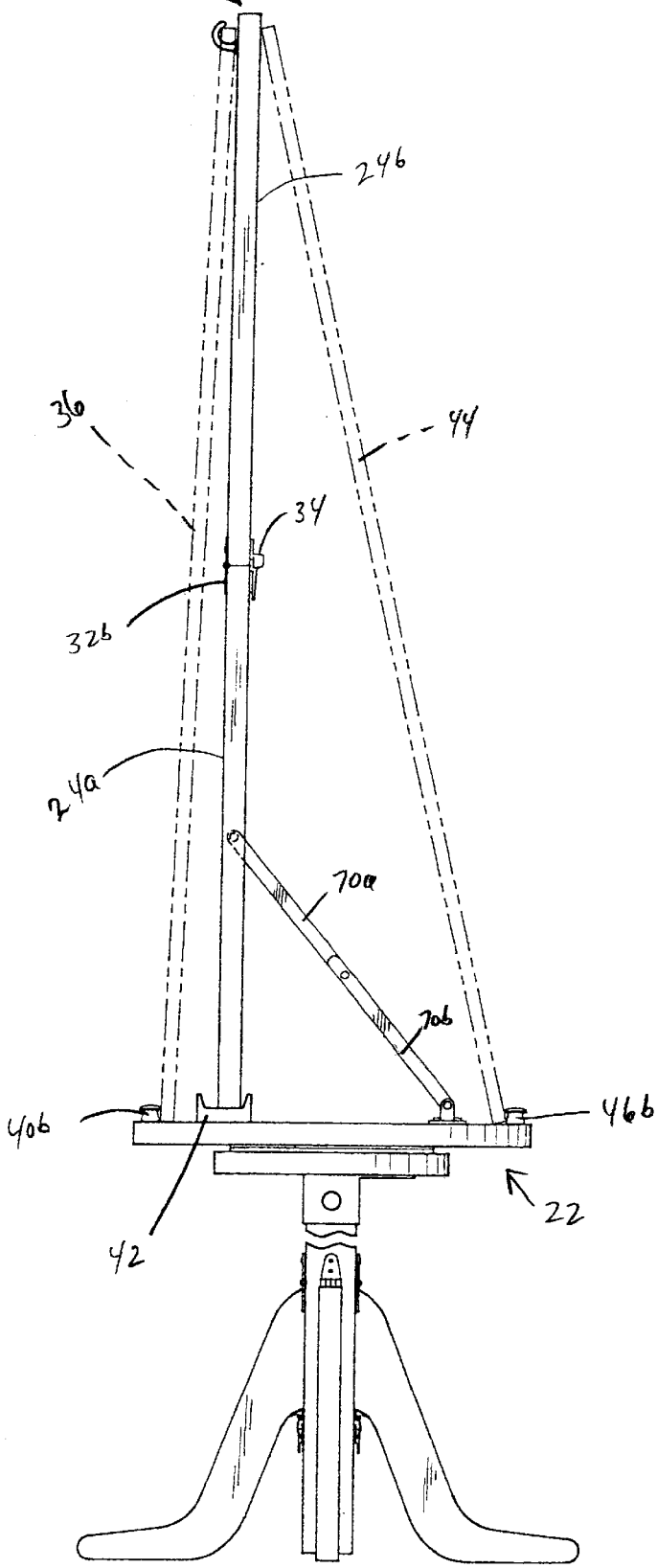
FIG. 5 is a side view illustrating the mounting of two visual displays on the rotatable base portion as inclined against the visual display support.
Figure 6:
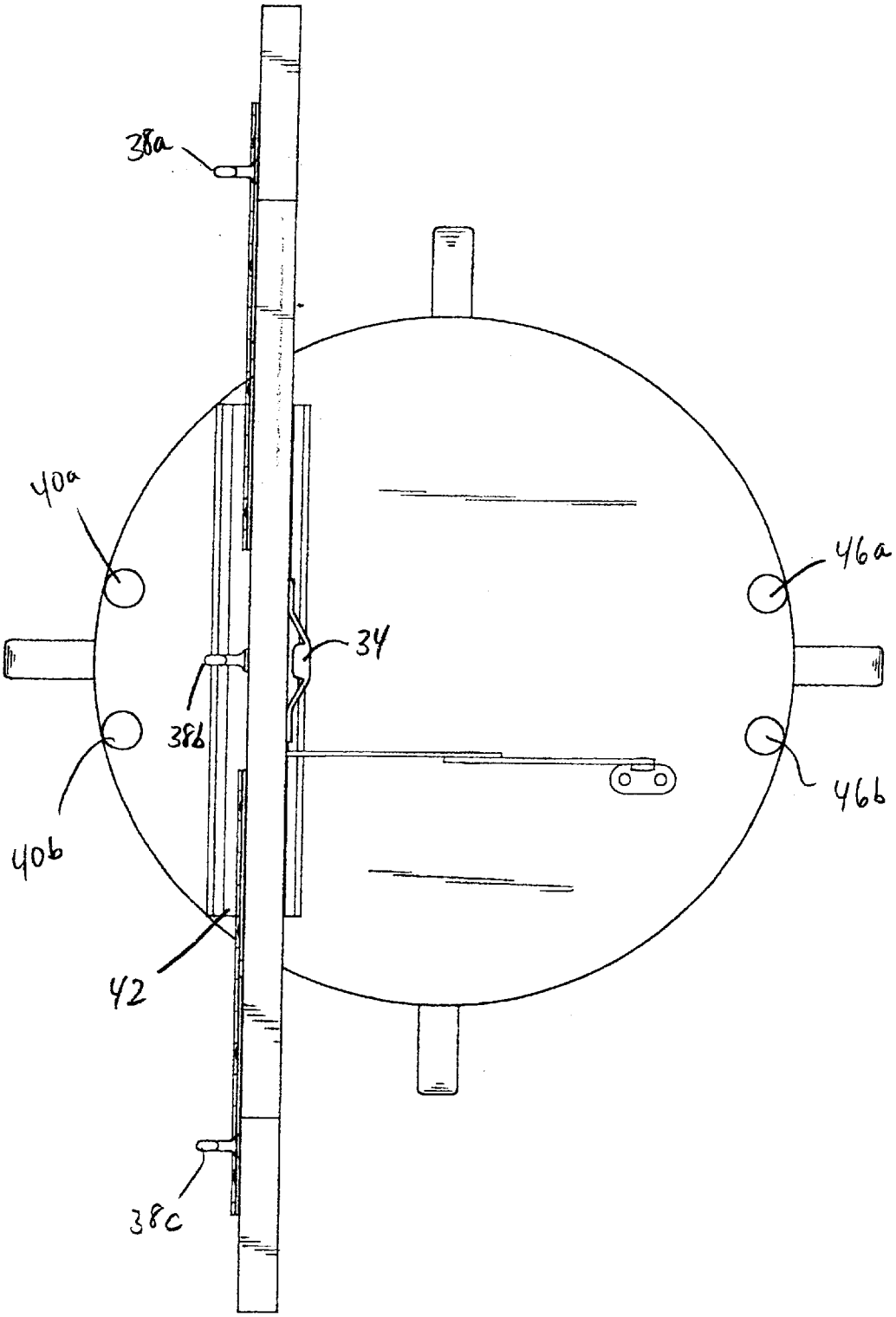
FIG. 6 is a top view of the present invention.

To facilitate a secure anchoring of the lower edge 36*b* of the visual display 36, an anchoring device, including projecting knobs 40*a*, 40*b* as shown in FIGS. 1, 5 and 6 may be used. However, it is within the scope of the present invention to use an alternate arrangement which blocks and retains the lower edge 36*b* of the visual display 36 so as to lean the visual display 36 against the front side 24*a* of the visual display support 24.

The lower edge of lower section 30 of the visual display support is placed in U-shaped channel bar 42 to aid in the stability of the visual display support. Bar 42 is used when the visual display support is positioned to extend from the base 22.

To accommodate the second visual display support 44, as shown in FIG. 5, a second set of projecting knobs 46*a*, 46*b* are located on an opposite side of the base 22 from the knobs 40*a*, 40*b*. The projecting knobs 46*a*, 46*b* serve a similar function to that of projecting knobs 40*a*, 40*b* and support a second visual display 44 on the base extending from the projecting knobs 46*a*, 46*b*. The lowermost edge of the visual display 44 is anchored on the base 22 and visual display 44 leans against the visual display support at its rear surface 24*b*.

Figure 3:
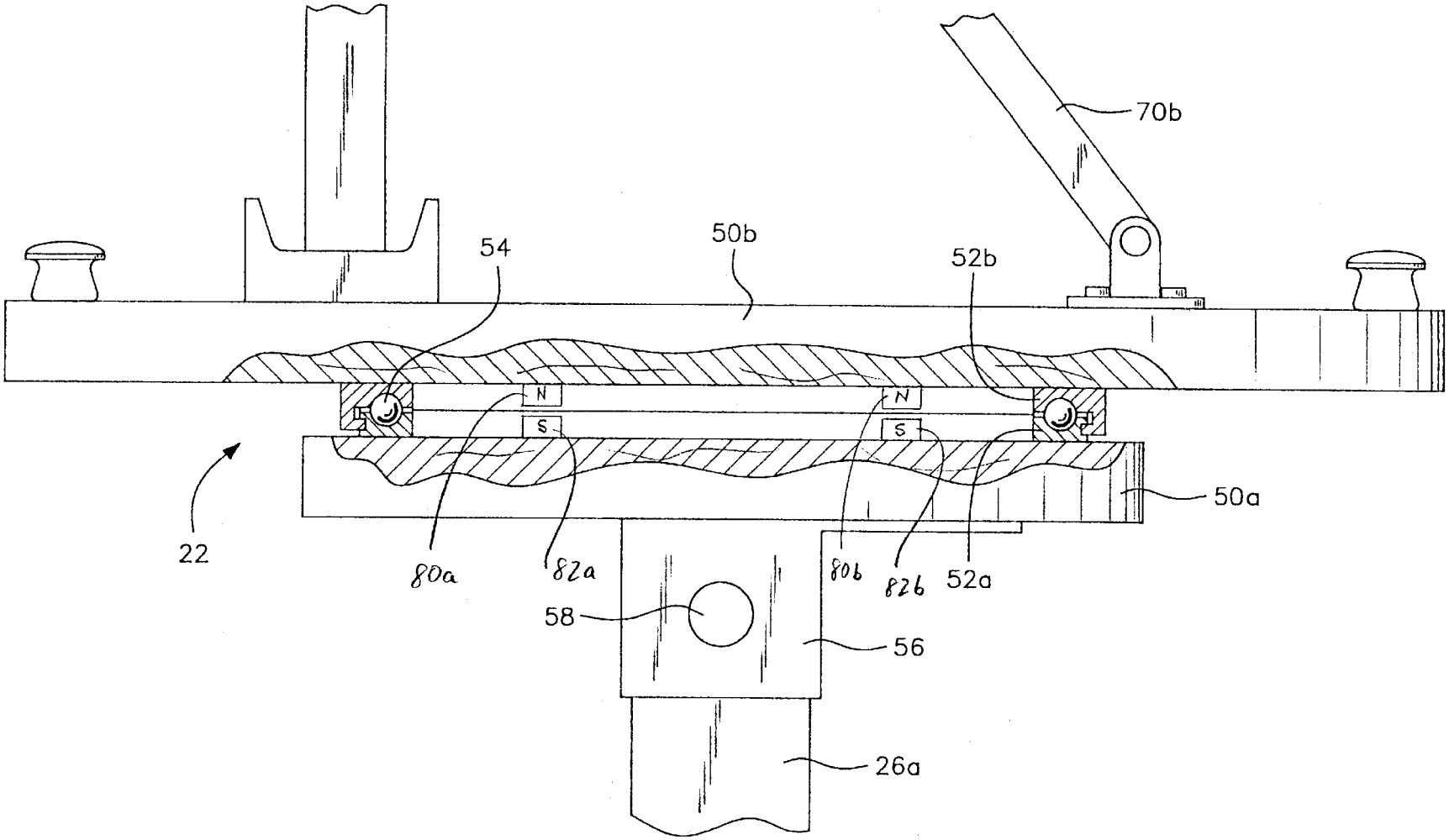
FIG. 3 is an enlarged view of the base including a fixed base portion and a rotatable base portion interconnected by a plurality of ball bearings and having opposed pole magnets aligned to hold the two portions in proper alignment.

The base 22 is shown in enlarged, partial cross-sectional form in FIG. 3. In this Figure, the base 22, includes a fixed portion 50*a* and a rotatable portion 50*b*. Attached to the fixed portion 50*a* is a track 52*a* and fixed to the rotatable base portion is a track 52*b*. The two tracks 52*a*, 52*b* include an arcuate portion between which are located a plurality of ball bearings 54 so as to facilitate rotation of the track 52*b* with respect to track 52*a*. The two tracks 52*a*, 52*b* are interconnected so as to secure the two base portions 50*a*, 50*b* together while allowing rotation of one base portion with respect to the other base portion.

By the rotation of the base portion 50*b* with respect to the base portion 58, the two visual displays 36, 44 may quickly be demonstrated to an audience. It is possible to quickly switch back and forth between the two displays without distracting the audience.

Two magnets 80*a* and 80*b* having a lowermost surface including an N-pole are positioned on the rotatable base portion 60*b*. Similarly, positioned on the fixed base portion 50*a* are two magnets 82*a* and 82*b* having an uppermost surface including an S-pole. The two sets of magnets are positioned on the two base portions so that an operator of the present invention may rotate the rotatable base portion, and without looking, feel when the opposed magnets approach each other due to their respective magnetic attractive pulls. Once the opposed pole magnets face each other, the magnets hold the relative positioning of the base portions so as to avoid unwanted rotation of the rotatable base portion, perhaps due to an unlevel support floor. The magnetic force between the opposed magnets is overcome by manual force imported to the rotatable base portion to rotate the rotatable base portion by 180 degrees and thus change the visual display facing an audience and lock in the new relative positions of the base portions.

In an alternate embodiment, there is only one magnet 80*a* and two magnets 82*a* and 82*b*. This embodiment would operate the same as with two magnets 80*a* and 80*b*, however, the holding force would be half because only one set of magnets are in alignment due to their magnetic attractive force.

In the embodiments shown in FIGS. 1 through 8, the vertical support stand 26 is pivotally anchored at its upper end 26*a* in a bracket 56 by interconnection to a pin 58 rotatably mounted in the bracket 56 by a series of detents (not shown). The vertical support stand is locked in position with respect to the fixed base member 50*a* and the vertical support stand is also pivotally mounted with respect to the fixed base portion 50*a* so as to move the vertical support stand towards the fixed base portion 50*a*.

Figure 7:
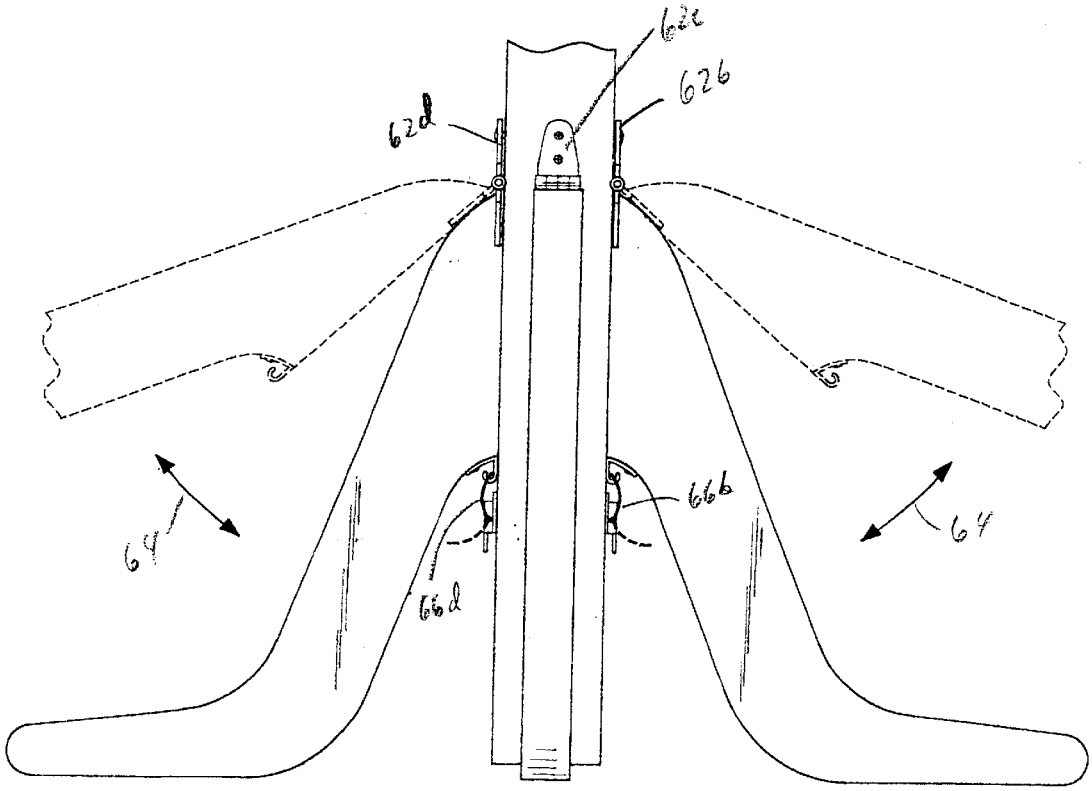
FIG. 7 illustrates the locking of the support feet for the vertical support stand and in dotted lines the pivotability of the support feet once the support feet are released from their locking clamps.

At the lower end 26*b* of the vertical support stand are four legs 60*a*, 60*b*, 60*c*, 60*d*. As shown in FIG. 7, each of the legs 60*a*, 60*b*, 60*c*, 60*d* is pivotally mounted by a hinge 62*a*, 62*b*, 62*c*, 62*d*, respectively, so as to move, as shown in dotted lines and in the direction of arrows 64 towards the upper end 26*a* of the vertical support stand. A clamp, 66*a*, 66*b*, 66*c*, 66*d*, for each leg, respectively secure the legs 60*a*, 60*b*, 60*c*, 60*d* in a locked position so as to secure the legs at the end 26*b* of the vertical support stand and form a stable arrangement for vertically supporting the collapsible revolving easel of the present invention.

Figure 8:
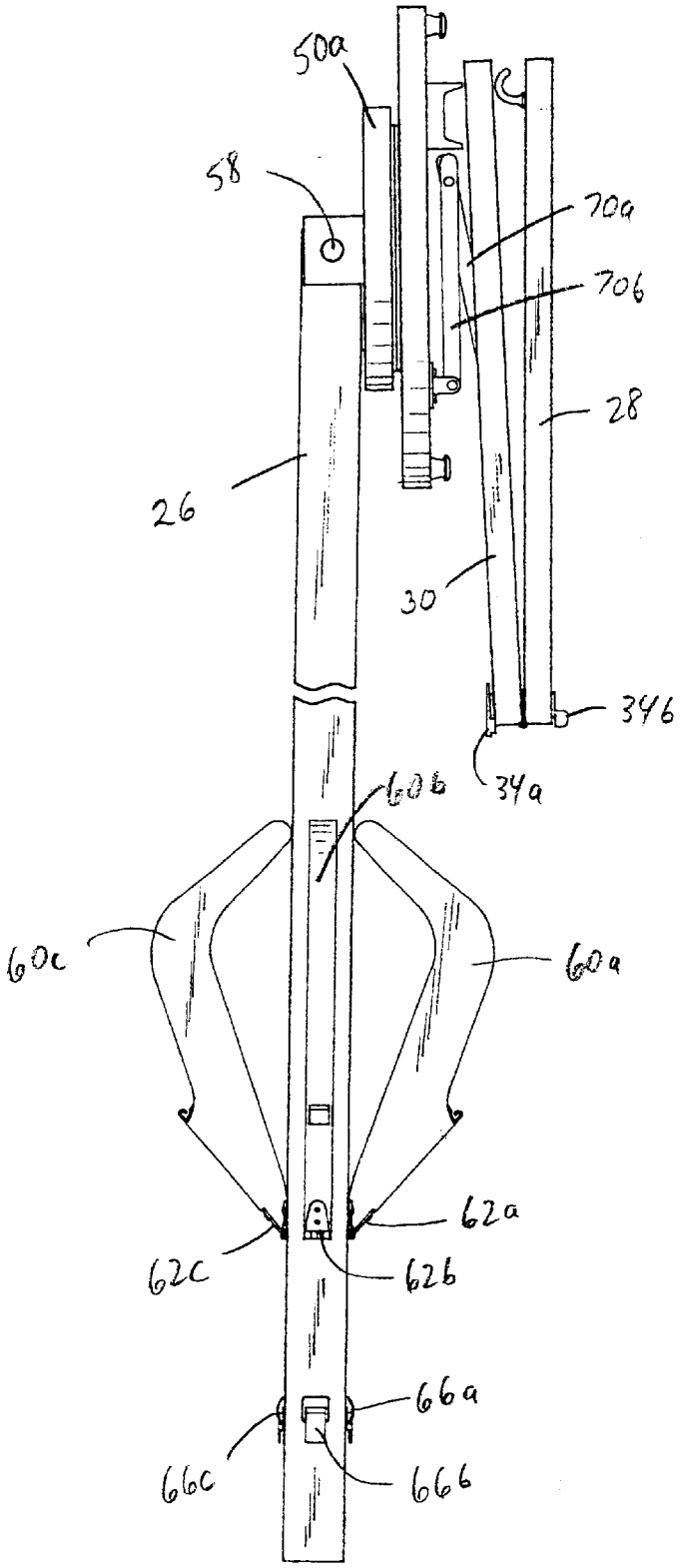
FIG. 8 illustrates a collapsed position of the revolving easel with the vertical display support folded and collapsed onto the rotatable base portion and the vertical support stand rotated 90 degrees with respect to the fixed base portion while the feet of the vertical support stand are folded into a collapsed position.

However, to facilitate transport of the collapsible easel, the clamps 66*a*, 66*b*, 66*c*, 66*d* are movable to the position shown in dotted lines in FIG. 7 and facilitate moving of the feet in the direction of arrows 64 to the position shown in FIG. 8. In the collapsed position shown in FIG. 8, the fixed base portion, 50*a* is also rotated about pin 58 so as to move the fixed base portion 50*a* by 90 degrees with respect to the vertical support stand 26.

Also, the upper section 28 of the display support is folded over the lower section 30 after releasing the interengaged portions 34*a*, 34*b* of the look assembly. An elongated hinged bracket 70 is also folded as shown in FIG. 8 so that the hinged bracket sections 70*a*, 70*b*, anchored respectively to the lower section 30 and rotatable base portion 50*b*, facilitate the upper and lower sections 28, 30 lying approximately parallel to the base portions 50*a*, 50*b* and the vertical and the support stand 26.

In the collapsed condition of the easel as shown in FIG. 8, the overall dimensions of the easel have been significantly reduced as compared to FIG. 1. By the tying together of the various sections, for example, upper section 28 to support stand 26 by bungee cords, for example, the entire assembly is easily transported while occupying a minimum of space.

Figure 9:
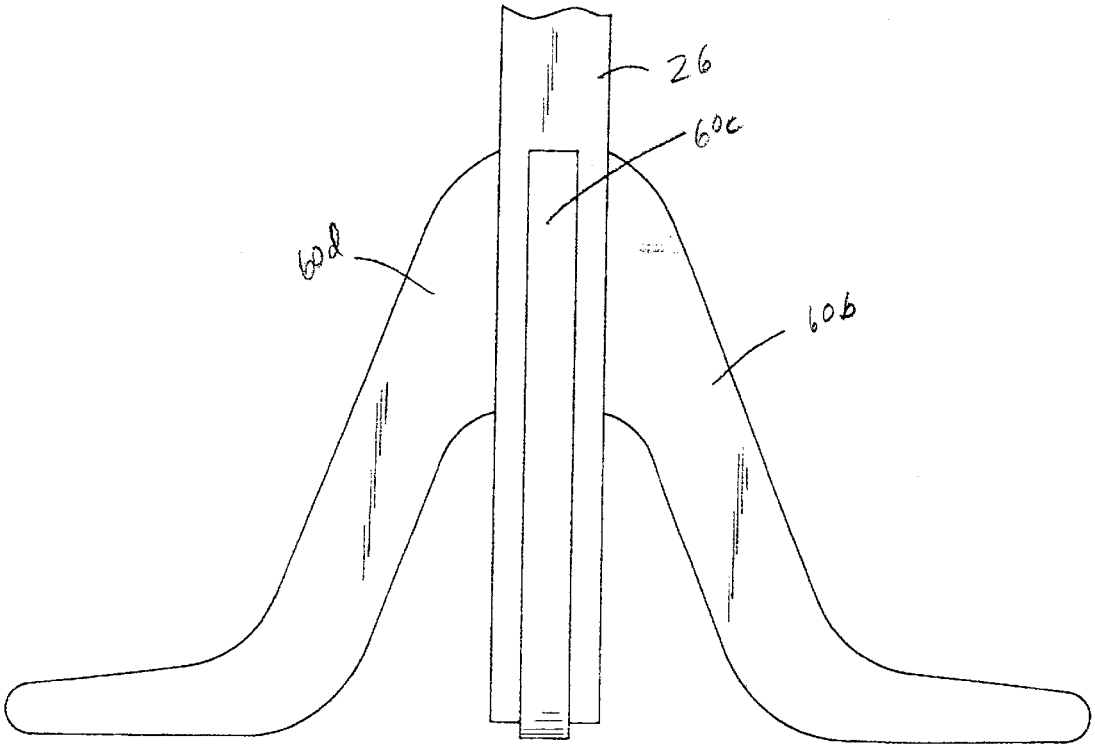
FIG. 9 illustrates an alternate embodiment for the support feet of the vertical support stand as being mounted integral with the vertical support stand in a more sedentary model of the present invention.

In an alternate embodiment of the present invention, where it may not be necessary to transport the easel to a remote location, and having the luxury of maintaining the easel at a single location, the feet, 60*a* through 60*d*, are fixed to the support stand 26 as shown in FIG. 9.

Figure 10:
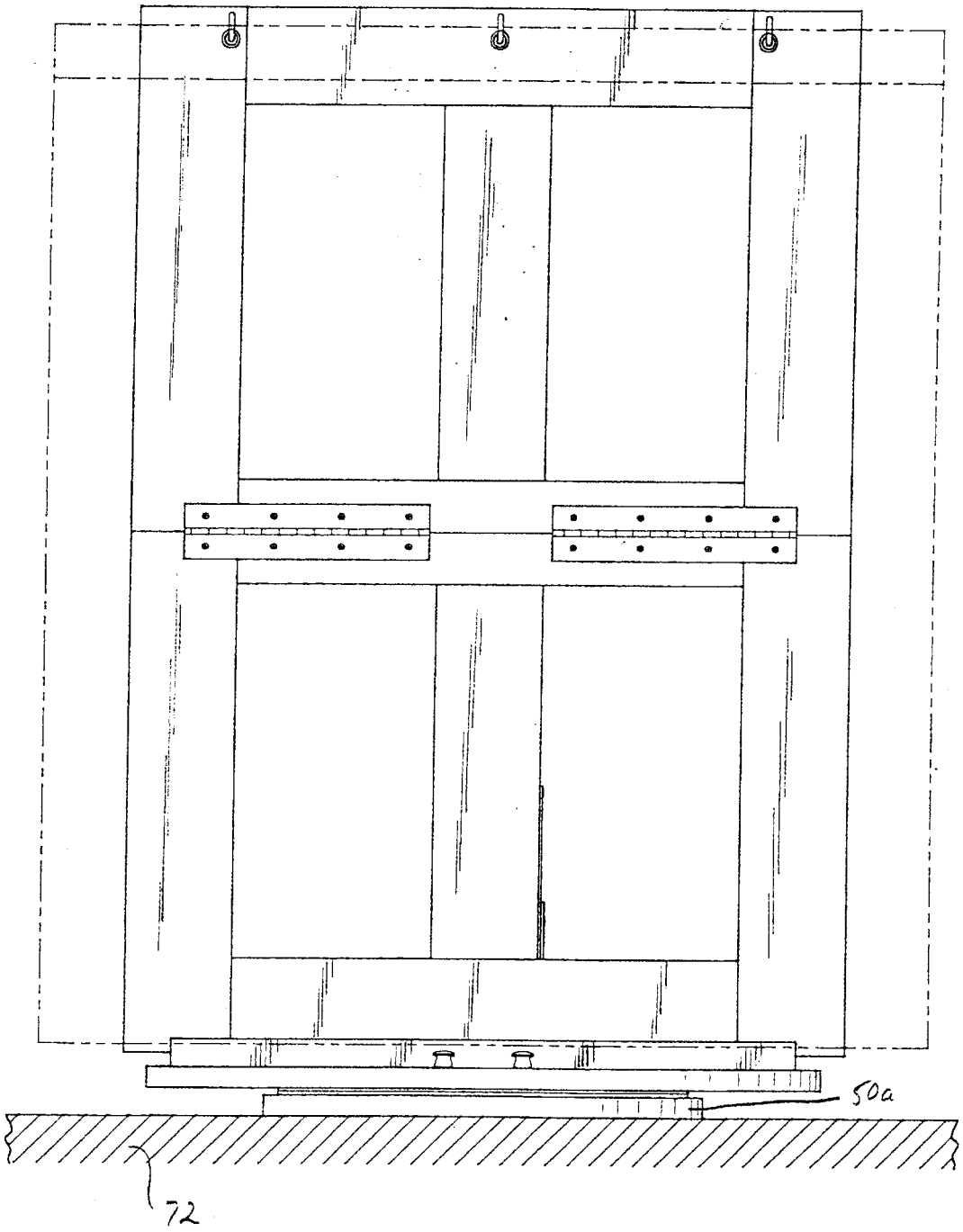
FIG. 10 illustrates a table top embodiment of the present invention without the vertical support stand but otherwise including all the features of the present invention as illustrated in FIG. 1.

In another alternate embodiment of the present invention as shown in FIG. 10, the fixed base portion 50*a* may be placed upon top of a table 72, when available. The base 22 and the display support 24 as shown in FIG. 1 will be the same for the embodiment as shown in FIG. 10.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A collapsible easel for supporting two visual displays, said collapsible easel comprising:

a base, a display support resting on the base, a hinged bracket interconnecting the base and the display support, the base including a fixed portion and a rotatable portion with the display support resting on the rotatable portion, the base further including two sets of anchoring portions for engaging a bottom edge of the visual displays, respectively, while an upper edge of the two visual displays engages the display support, and a support stand connected to the fixed portion of the base, the support stand including a plurality of legs, the legs being pivotally mounted on a lower portion of a bar interconnecting the fixed portion of the base and the legs.

2. The collapsible easel as claimed in claim 1, wherein the legs are releasably locked to the bar.

3. The collapsible easel as claimed in claim 1, wherein the display support includes two portions interconnected to each other.

4. The collapsible easel as claimed in claim 3, wherein the two portions are interconnected by a hinge.

5. The collapsible easel as claimed in claim 3, wherein the hinged bracket is connected at an opposite end to the rotatable portion of the base.

6. The collapsible easel as claimed in claim 3, wherein the hinged bracket is connected at one end to a lower one of the two portions of the display support.

7. The collapsible easel as claimed in claim 3, wherein the two portions are movable between a locked continuously extending position to an unlocked folded position.

8. The collapsible easel as claimed in claim 1, wherein the display support rests in a channel bar, the channel bar being secured to the base.

9. A collapsible easel for supporting two visual displays, said collapsible easel comprising:

a base, a display support resting on the base, a hinged bracket interconnecting the base and the display support, the base including a fixed portion and a rotatable portion with the display support resting on the rotatable portion, one of the fixed portion and the rotatable portion including at least one magnet and the other of the fixed portion and the rotatable portion including two magnets for holding a position of the rotatable portion with respect to the fixed portion when at least two of the magnets are aligned, and the base further including two sets of anchoring portions for engaging a bottom edge of the visual displays, respectively, while an upper edge of the two visual displays engages the display support.

10. The collapsible easel as claimed in claim 9, wherein said two magnets are positioned 180 degrees with respect to each other on the other of the fixed portion and the rotatable portion.

11. The collapsible easel as claimed in claim 9, wherein said at least one magnet includes two magnets.

* * * * *